US011668328B2

(12) United States Patent
Ji et al.

(10) Patent No.: US 11,668,328 B2
(45) Date of Patent: Jun. 6, 2023

(54) NOISE REDUCTION DEVICE FOR OUTLET SIDE OF FAN AND HEAT EXCHANGE SYSTEM INCLUDING THE SAME

(71) Applicant: CARRIER CORPORATION, Palm Beach Gardens, FL (US)

(72) Inventors: JunJie Ji, Shanghai (CN); Yuling Shi, Shanghai (CN); Xin Cheng, Shanghai (CN); Haijun Li, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/132,889

(22) Filed: Dec. 23, 2020

(65) Prior Publication Data

US 2022/0025906 A1 Jan. 27, 2022

(30) Foreign Application Priority Data

Jul. 27, 2020 (CN) ..... 202021499757.7

(51) Int. Cl.
*F04D 29/66* (2006.01)
*F04D 29/54* (2006.01)

(52) U.S. Cl.
CPC ..... *F04D 29/665* (2013.01); *F04D 29/545* (2013.01); *F05D 2250/52* (2013.01); *F05D 2260/96* (2013.01)

(58) Field of Classification Search
CPC .. F04D 29/665; F04D 29/545; F05D 2250/52; F05D 2260/96
See application file for complete search history.

(56) References Cited

U.S. PATENT DOCUMENTS 2,225,398 A 12/1940 Hamblin
4,180,141 A * 12/1979 Judd ..... F01D 25/30 181/217

(Continued)

FOREIGN PATENT DOCUMENTS

CN 1236200 C 1/2006
CN 201723508 U 1/2011

(Continued)

OTHER PUBLICATIONS

European Search Report for Application No. 20215990.1; dated Jun. 14, 2021; 10 Pages.

*Primary Examiner* — Aaron R Eastman
(74) *Attorney, Agent, or Firm* — Cantor Colburn LLP

(57) ABSTRACT

The utility model relates to a noise reduction device for an outlet side of a fan, and a heat exchange system including the noise reduction device. The noise reduction device includes: a connecting portion configured to be connected with at least a part of the air duct cover, and form an accommodation space communicating with an airflow on the outlet side via at least one of the through holes; and at least one first chamber and/or at least one second chamber, the first chamber being located in the accommodation space and filled with a sound-absorbing material, and the second chamber being located in the accommodation space and configured as a resonant noise-reduction cavity. The utility model is easy to manufacture, install and maintain, the noise reduction effect is obvious, and therefore the utility model has significant practicability.

8 Claims, 3 Drawing Sheets

(56) References Cited

U.S. PATENT DOCUMENTS

| | | | | |
|---|---|---|---|---|
| 4,244,441 | A * | 1/1981 | Tolman | F01D 25/30 181/213 |
| 4,508,486 | A | 4/1985 | Tinker | |
| 5,426,268 | A | 6/1995 | Yazici et al. | |
| 5,783,780 | A * | 7/1998 | Watanabe | F02M 35/1272 181/229 |
| 6,537,490 | B2 | 3/2003 | Han | |
| 6,896,095 | B2 | 5/2005 | Shah et al. | |
| 10,208,769 | B2 | 2/2019 | Cao et al. | |
| 2001/0015302 | A1 | 8/2001 | Lundgren | |
| 2002/0064453 | A1 * | 5/2002 | Tse | F02K 1/386 415/119 |
| 2008/0017442 | A1 * | 1/2008 | Douglas | B64D 33/02 181/213 |
| 2015/0337684 | A1 * | 11/2015 | Topol | F01D 1/02 415/1 |
| 2015/0344142 | A1 * | 12/2015 | Roach | F02C 7/045 181/292 |
| 2016/0017810 | A1 * | 1/2016 | Lord | F02C 7/24 60/725 |
| 2016/0031163 | A1 * | 2/2016 | Wadsworth | F02K 1/827 156/64 |
| 2018/0030853 | A1 * | 2/2018 | Merchant | H02K 7/1823 |
| 2020/0101690 | A1 * | 4/2020 | Oishi | B64D 33/02 |
| 2020/0132018 | A1 * | 4/2020 | Kinlen | B32B 5/02 |
| 2020/0132080 | A1 * | 4/2020 | Chen | F04D 29/4226 |
| 2020/0309028 | A1 * | 10/2020 | Murugappan | F02K 1/827 |
| 2020/0392899 | A1 * | 12/2020 | Meslioui | F02C 7/045 |

FOREIGN PATENT DOCUMENTS

| | | | |
|---|---|---|---|
| CN | 101713335 | | 11/2014 |
| CN | 106762122 | A | 5/2017 |
| CN | 108953238 | A | 12/2018 |
| CN | 109072816 | A | 12/2018 |
| CN | 109210013 | A | 1/2019 |
| CN | 208900430 | U | 5/2019 |
| CN | 110211560 | A | 9/2019 |
| DE | 102015224344 | A1 | 6/2017 |
| EP | 2784329 | A1 | 10/2014 |
| EP | 2255073 | B1 | 11/2018 |
| EP | 3115575 | B1 | 6/2019 |
| GB | 1485988 | | 9/1977 |
| GB | 1489640 | | 10/1977 |
| JP | 2002371998 | A | 12/2002 |
| JP | 2004036495 | A | 2/2004 |
| JP | 3644973 | B2 | 2/2005 |
| KR | 100736816 | B1 | 7/2007 |

* cited by examiner

NOISE REDUCTION DEVICE FOR OUTLET SIDE OF FAN AND HEAT EXCHANGE SYSTEM INCLUDING THE SAME

CROSS-REFERENCE TO RELATED APPLICATIONS

This application claims the benefit of Chinese Application No. 202021499757.7 filed Jul. 27, 2020, the disclosure of which is incorporated herein by reference in its entirety

BACKGROUND

The utility model relates to the technical field of noise reduction, and in particular to a noise reduction device for an outlet side of a fan, and a heat exchange system including the noise reduction device.

At present, various types of fan devices have been widely used in numerous heat exchange systems, in which mechanical rotations of several fan blades in the fans are used to form surrounding airflows, thereby promoting a transfer or exchange of heat energy between different objects. Noise problem may occur during fan operation. Although many technical means have been provided in the prior art to attempt to solve the fan noise problem, it has been recognized by the present application that these technical means still have some shortcomings and defects for example in terms of overall design and construction, noise reduction effect, ease of installation, use and maintenance costs, so they can be further improved and optimized.

BRIEF DESCRIPTION

In view of the foregoing, the utility model provides a noise reduction device for an outlet side of a fan, and a heat exchange system including the noise reduction device, so as to resolve or at least alleviate one or more of the problems described above as well as problems of other aspects existing in the prior art.

Firstly, according to a first aspect of the utility model, a noise reduction device for an outlet side of a fan is provided, the outlet side being provided with an air duct cover with one or more through holes, and the noise reduction device comprising:

a connecting portion configured to be connected with at least a part of the air duct cover, and form an accommodation space communicating with an airflow on the outlet side via at least one of the through holes; and at least one first chamber and/or at least one second chamber, the first chamber being located in the accommodation space and filled with a sound-absorbing material, and the second chamber being located in the accommodation space and configured as a resonant noise-reduction cavity.

In the noise reduction device according to the utility model, optionally, the first chamber is configured to reduce noises in a preset frequency spectrum range, and noise peaks in the preset frequency spectrum range are all less than a preset value.

In the noise reduction device according to the utility model, optionally, the resonant noise-reduction cavity is configured to reduce preset single-frequency noises of the fan, and when a ratio between the energy of the single-frequency noises and the noise energy of the fan is less than a preset value, only the first chamber is provided in the accommodation space.

In the noise reduction device according to the utility model, optionally, the noise reduction device comprises at least two second chambers for reducing at least two single-frequency noises of different frequencies respectively.

In the noise reduction device according to the utility model, optionally, the first chamber and the second chamber are arranged in a circumferential direction of the air duct cover, and are separated from each other by a separator arranged in the accommodation space.

In the noise reduction device according to the utility model, optionally, the connecting portion has a top portion, a side portion, and a bottom portion, an end of each of the top portion and the bottom portion is connected with an end of the side portion respectively, and the other end of each of the top portion and the bottom portion is connected with the air duct cover respectively, for assembling the connecting portion and the air duct cover together to form a cylindrical shape.

In the noise reduction device according to the present utility model, optionally, the top portion has an extension part configured to extend toward the center of the air duct cover relative to the end of the air duct cover.

In the noise reduction device according to the utility model, optionally, the connecting portion is integrally formed by using a sheet metal.

In the noise reduction device according to the utility model, optionally, the through hole communicating with the first chamber is configured to be different from the through hole communicating with the second chamber.

Secondly, according to a second aspect of the utility model, a heat exchange system is also provided, which comprises one or more fans, wherein an outlet side of the fan is provided with an air duct cover with one or more through holes, and the heat exchange system further comprises one or more noise reduction devices as described in any one of the above, which is installed on the outlet side of at least one of the fans and assembled with the air duct cover.

From the following detailed description combined with the accompanying drawings, the principles, features, characteristics and advantages of the technical solutions according to the utility model will be clearly understood. As compared with the prior art, the overall structure of the noise reduction device is simple, and the noise reduction device is very easy to manufacture, install and maintain. It can be directly installed on the air duct cover of existing fans, so that the original height of the outlet side of the fan will not change, and a targeted noise reduction can be performed on broadband/discrete noises of the fan through the corresponding first and second chambers respectively. The technical effect is obvious, which will advantageously improve the on-site environment. The utility model has significant practicability.

BRIEF DESCRIPTION OF THE DRAWINGS

The technical solutions of the utility model will be described in further detail below with reference to the accompanying drawings and embodiments. However, it should be understood that these drawings are designed merely for the purpose of explanation and only intended to conceptually illustrate the structural configurations described herein, and are not required to be drawn to scale.

DETAILED DESCRIPTION

Figure 1:
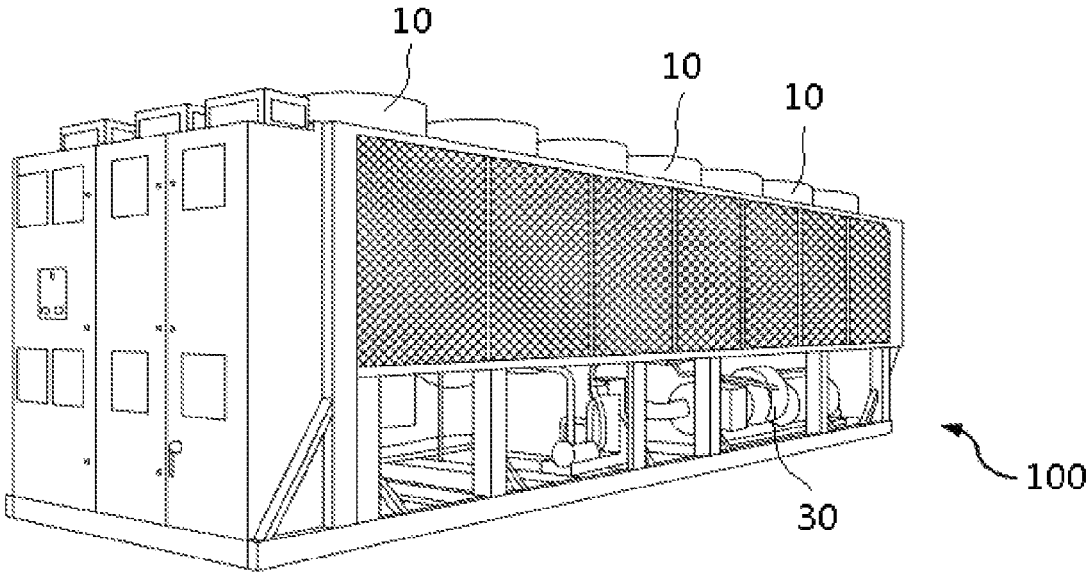
FIG. 1 is a schematic perspective view of an existing air-cooled unit.

First, it should be noted that the components, configurations, characteristics, advantages and the like of the noise reduction device for an outlet side of a fan and the heat exchange system including the noise reduction device according to the utility model will be described below by way of example. However, it should be understood that all the descriptions are merely given for illustration, and should not be understood as limiting the utility model in any way. Herein, the technical terms "first" and "second" are merely used for distinguishing purpose, and are not intended to indicate their order and relative importance. The technical term "connect (or connected, etc.)" covers a situation where a specific component is directly connected to another component and/or indirectly connected to another component. The technical terms "top", "bottom", "upper", "lower", "inner", "outer", "horizontal", "vertical/perpendicular" and their derivatives should be associated with the orientations in the drawings. The utility model may take various alternative orientations, unless otherwise clearly indicated.

In addition, for any single technical feature described or implied in the embodiments mentioned herein or any single technical feature shown or implied in individual drawings, the utility model still allows for any combination or deletion of these technical features (or equivalents thereof) without any technical obstacle, thereby obtaining more other embodiments of the utility model that may not directly mentioned herein. In addition, for the sake of simplifying the drawings, identical or similar elements and features may be marked in only one or more places in the same drawing.

FIG. 1 schematically shows a general structure of an existing air-cooled unit 100. The air-cooled unit 100 may be installed in many places such as high-rise buildings, stadiums, industrial plants, ships, etc., for implementing functions such as cooling, heating and air exchange. It can be understood that any possible component, device or apparatus such as a fan 20, a compressor 30, a condenser, an evaporator, an expansion device, valves, pumps and the like may be provided in the air-cooled unit 100, so these items that are already known to those skilled in the art will not be explained herein.

Figure 2:
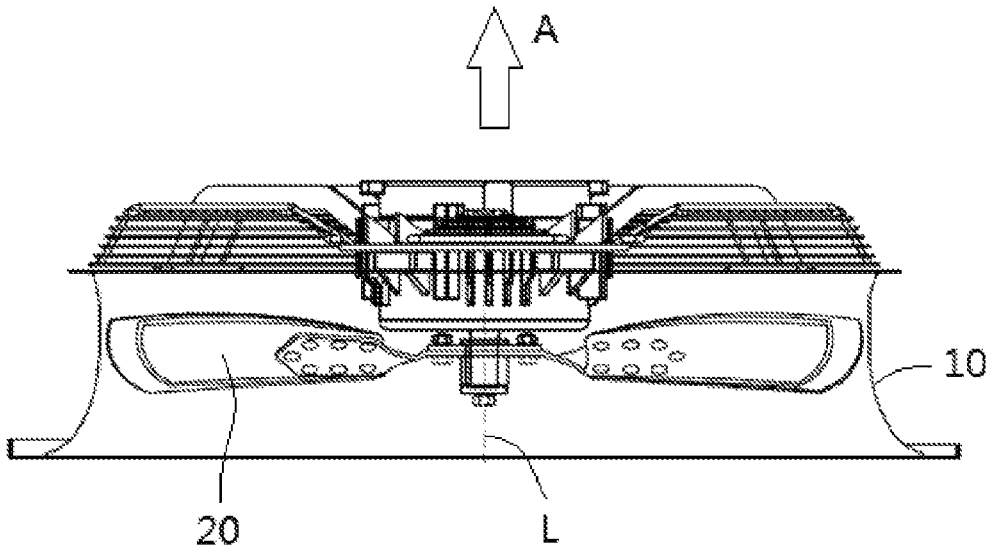
FIG. 2 is a schematic side view of a fan with an air duct cover in the air-cooled unit shown in FIG. 1, in which the noise reduction device according to the utility model has not yet been implemented on the air duct cover.

As shown in FIG. 2, the fan 20 is usually driven by power (for example, a motor provides a driving force) so that blades of the fan 20 rotate around a rotation axis L, thereby driving the surrounding air to flow in the direction indicated by the arrow A for heat transfer or exchange. However, noises will be generated during the operation of the fan. In some cases, these noises may exceed the limit or requirement, resulting in an undesired noise problem. In this regard, the above problem can be effectively solved by adopting the example of the noise reduction device for an outlet side of a fan shown in FIGS. 3 and 4.

Specifically, in this exemplary embodiment, the noise reduction device 1 is provided to be coordinatively installed with an air duct cover 10 (also often referred to as "air cylinder", "air coil", "fan cover", etc.) arranged on the outlet side of the fan 20, that is, under the condition of making full use of the original device without increasing the height of the system, the object such as reducing fan noises can be effectively achieved by directly assembling the noise reduction device 1 to the air duct cover 10 and providing through holes 8.

Figure 3:
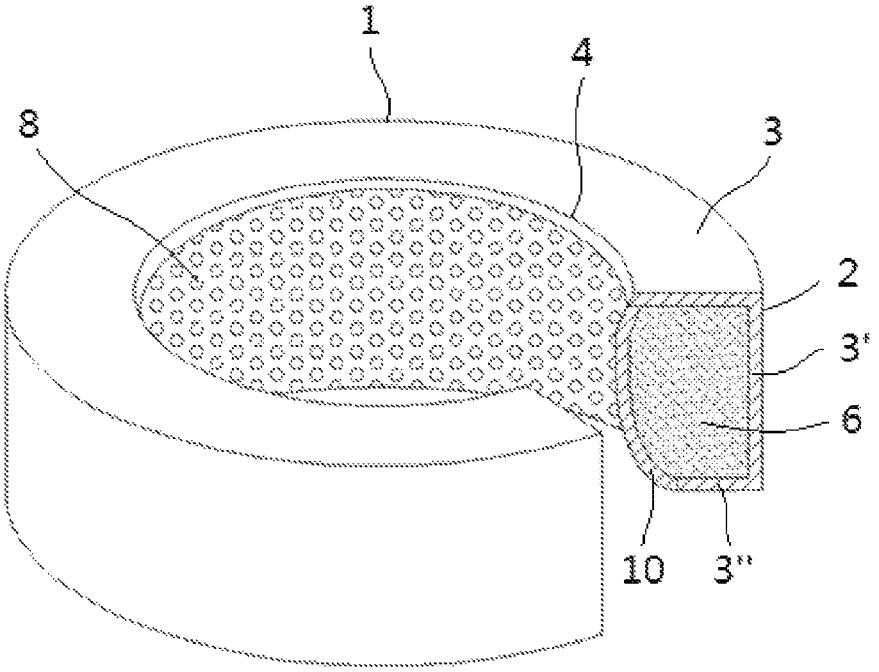
FIG. 3 is a schematic perspective view of an embodiment of the noise reduction device according to the utility model assembled with the air duct cover shown in FIG. 2, in which a partial cross-sectional structure is also shown.
Figure 4:
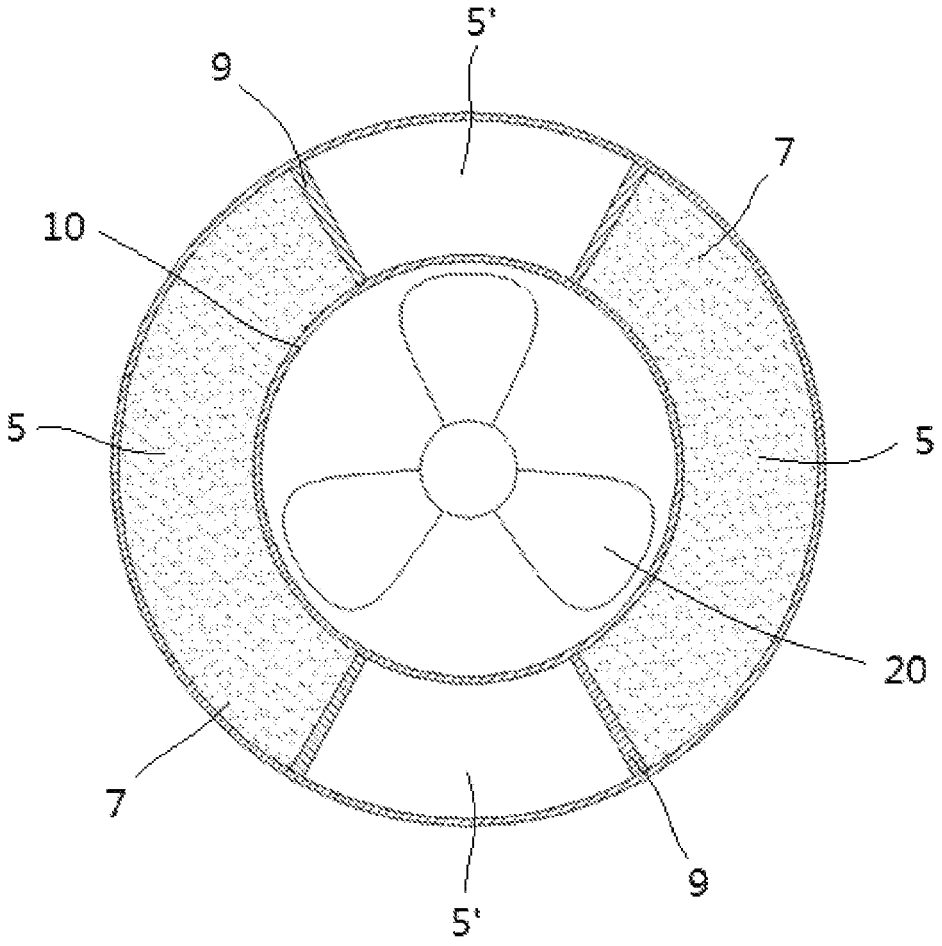
FIG. 4 is a schematic top view of the embodiment shown in FIG. 3, in which fan blades are also shown.

Reference is made to FIGS. 3 and 4 at the same time, the noise reduction device 1 may be provided with a connecting portion 2 so that the noise reduction device 1 can be assembled to the air duct cover 10 via the connecting portion 2, thus forming a first chamber 5 and a second chamber 5'. These two types of chambers will be used to reduce noises of different targets respectively, which will be described in detail later. As far as the connecting portion 2 is concerned, the utility model does not intend to impose any restrictions on the material used, the shape and structure, processing techniques, connection method thereof, for example, as long as an accommodation space 6 can be formed by assembling the connecting portion 2 with the air duct cover 10. The accommodation space 6 can maintain communication with the airflow on the outlet side of the fan 20 via the through holes 8 provided on the air duct cover 10, and the above-mentioned first chamber 5 and second chamber 5' are both arranged in the accommodation space 6.

As an example, the connecting portion 2 may be configured into a structure having for example a top portion 3, a side portion 3', and a bottom portion 3". This can be achieved by using a sheet metal and applying appropriate processing techniques (such as bending, stamping, etc.) to integrally form the top portion 3, the side portion 3' and the bottom portion 3" very conveniently. As shown in FIG. 3, the top portion 3 and the bottom portion 3" formed by the connecting portion 2 may be respectively connected with the air duct cover 10. Accordingly, after the assembly is completed, the connecting portion 2 and the air duct cover 10 together form the cylindrical shape as shown in FIG. 3, thereby forming the mentioned accommodation space 6, in which the above-mentioned first chamber 5 and/or second chamber 5' can be arranged.

For another example, an extension part 4 may also be optionally provided on the connecting portion 2, and the extension part 4 extends toward the center of the air duct cover 10 from the junction of the top portion 3 and the end of the air duct cover 10, so that the extension part 4 can be used to prevent foreign objects such as rainwater from entering sound-absorbing material 7 in the first chamber 5 or entering the second chamber 5' to affect its working performance, and also prevent the sound generated during the operation of the fan from leaking outward from the top portion 3. Regarding specific conditions such as the installation length and processing method of the extension part 4, the utility model does not impose specific restrictions and allows for arrangement according to actual application conditions.

Of course, it should be understood that the above content is only used as an exemplary description. According to some other embodiments of the utility model, not only any suitable materials such as plastics, composite materials are allowed to be used alone or in combination, but also any suitable processing methods such as injection molding, welding, screwing, gluing are allowed to be used alone or in combination during manufacturing and assembly.

As shown in FIGS. 3 and 4, in the noise reduction device 1, the first chamber 5 is arranged in the accommodation space 6, and the sound-absorbing material 7 is filled in the chamber to absorb fan noises entering from the through holes 8. The sound-absorbing material 7 may be any feasible suitable material which can include, but is not limited to, for example, sound-absorbing sponge, glass fiber, rock wool, felt, non-woven fabric or any combination thereof. It should be noted that according to different application requirements, broadband noises that are expected to be eliminated can be absorbed by selectively setting the type and thickness of the sound-absorbing material 7, the filling ratio of the sound-absorbing material 7 in the first chamber 5, etc., thereby reducing noises in a preset frequency spectrum range (for example, the sound range 20 Hz-20 kHz that the human ear can recognize, or any sub-range thereof; noise peaks in the preset frequency spectrum range are less than a preset value) in a targeted manner; that is, such noises are broadband noises in nature, and they exhibit as not having significant noise peaks since they do not exceed the above preset value.

The second chamber 5' is also arranged in the accommodation space 6. It can be constructed in the form of a resonant noise-reduction cavity in order to reduce preset single-frequency noises of the fan (which usually have significant noise peaks due to exceeding the above preset value); namely, the second chamber 5' is designed and provided for discrete noises which are different from the broadband noises targeted by the first chamber 5 above.

In this way, by flexibly designing a combination of the first chamber 5 and the second chamber 5' in the accommodation space 6, the broadband noises and/or discrete noises that are expected to be processed in the fan noises can be reduced quite effectively.

For example, in an optional situation, a ratio between the energy of the single-frequency noises collected as the expected processing target and the noise energy of the fan 20 can be used to determine whether to provide the second chamber 5' in the accommodation space 6. Specifically, if the above ratio exceeds a preset value (which may be flexibly set according to different application requirements), then the second chamber 5' can be provided according to the magnitude of the frequency of the single-frequency noise; otherwise, if the ratio is less than the above preset value, then there is no need to additionally provide the second chamber 5' in the accommodation space 6, that is, only the first chamber 5 is required to be provided in this situation since this situation shows that the noise reduction requirements at this time are mainly for broadband noises without significant single-frequency noise peaks. Therefore, the second chamber 5' can be omitted, which will appropriately simplify the overall structure and reduce costs.

For another example, in an optional situation, the specific number, arrangement position, volume and the like of the first chamber 5 and/or the second chamber 5' can be designed very flexibly. For example, one, two or even more second chambers 5' can be provided at the same time, so that they can be used to reduce discrete noises of different frequencies respectively in a targeted manner. In addition, as shown in FIG. 4, a plurality of first chambers 5 and second chambers 5' may also be separated by separators 9 (such as partitions, etc.) in the accommodation space 6 in a circumferential direction of the air duct cover 10. These first chambers 5 (or second chambers 5') may each be completely or substantially the same in terms of shape, structure, volume, etc., or may be different from each other.

In addition, it should also be pointed out that although in the embodiments given above, the noise reduction device 1 is arranged to form a complete cylindrical shape around the entire outer circumference of the air duct cover 10, the utility model also allows the noise reduction device 1 to be arranged only around a part of the air duct cover 10, so that it is not necessary to form a single complete cylindrical shape as shown in FIG. 4. Therefore, it is actually possible to form one, two or more separate parts of any feasible shape.

According to the design idea of the utility model, a heat exchange system is also provided, which may include one or more fans, and one or more noise reduction devices according to the utility model as described above. Such noise reduction devices can be installed as required on the existing air duct cover on the outlet side of the fan that needs noise reduction very conveniently and quickly. The entire installation operation is simple, and the maintenance is very easy. The overall retrofit cost is limited; especially, the original height of the outlet side of the fan will not be affected, and the broadband/discrete noises of the fan can be significantly reduced in a targeted manner. For example, actual tests show that in some implementation environments, on-site noises of the whole unit can be reduced at least by 1.3~2.4 dBA.

In addition, it should be noted that the heat exchange system according to the utility model may be of many types such as a refrigeration unit, and for different fans in the same system, different embodiments of the noise reduction device according to the utility model may be installed and applied respectively so as to meet different noise reduction requirements that these fans may have in a more sufficient, flexible and targeted manner. Therefore, the utility model is not only quite practical, but also has a wide range of application.

The noise reduction device for an outlet side of a fan and the heat exchange system including the noise reduction device according to the utility model have been elaborated above in detail by way of example only. These examples are merely used to illustrate the principles and embodiments of the utility model, rather than limiting the utility model. Various modifications and improvements can be made by those skilled in the art without departing from the spirit and scope of the utility model. For example, although identical through holes can be evenly arranged on the air duct cover, it is also allowed to set these through holes respectively communicating with the first chamber and the second chamber to be not exactly the same in terms of size, porosity, shape, layout and the like, so as to fully meet different application requirements. Therefore, all equivalent technical solutions should fall within the scope of the utility model and be defined by the claims of the utility model.

What is claimed is:

1. A noise reduction device for an outlet side of a fan, the outlet side being provided with an air duct cover with one or more through holes, wherein the noise reduction device comprises:

a connecting portion configured to be connected with at least a part of the air duct cover, and form an accommodation space communicating with an airflow on the outlet side via at least one of the through holes; and at least one first chamber and at least one second chamber, the first chamber being located in the accommodation space and filled with a sound-absorbing material, and the second chamber being located in the accommodation space and configured as a resonant noise-reduction cavity;

wherein a first through hole, of the one or more through holes, communicating with the first chamber has a different size or shape than a second through hole, of the one or more through holes, communicating with the second chamber;

wherein the connecting portion has a top portion, a side portion, and a bottom portion, an end of each of the top portion and the bottom portion is connected with an end of the side portion respectively, and the other end of each of the top portion and the bottom portion is connected with the air duct cover respectively, for assembling the connecting portion and the air duct cover together to form a cylindrical shape;

wherein the top portion has an extension part configured to extend toward a center of the air duct cover relative to an end of the air duct cover.

2. The noise reduction device according to claim 1, wherein the first chamber is configured to reduce noises in a preset frequency spectrum range, and noise peaks in the preset frequency spectrum range are all less than a preset value.

3. The noise reduction device according to claim 1, wherein the resonant noise-reduction cavity is configured to reduce preset single-frequency noises of the fan, and when a ratio between the energy of the single-frequency noises and a noise energy of the fan is less than a preset value, only the first chamber is provided in the accommodation space.

4. The noise reduction device according to claim 1, wherein the noise reduction device comprises at least two second chambers for reducing at least two single-frequency noises of different frequencies respectively.

5. The noise reduction device according to claim 1, wherein the first chamber and the second chamber are arranged in a circumferential direction of the air duct cover, and are separated from each other by a separator arranged in the accommodation space.

6. The noise reduction device according to claim 1, wherein the connecting portion is integrally formed by using a sheet metal.

7. A heat exchange system, comprising one or more fans, an outlet side of the fan being provided with an air duct cover with one or more through holes, wherein the heat exchange system further comprises one or more noise reduction devices according to claim 1, which is installed on the outlet side of at least one of the fans and assembled with the air duct cover.

8. The noise reduction device according to claim 1, wherein the one or more through holes include a plurality of through holes communicating with the first chamber and a plurality of through holes communicating with the second chamber.

* * * * *